US006988616B2

(12) United States Patent
Chen

(10) Patent No.: US 6,988,616 B2
(45) Date of Patent: Jan. 24, 2006

(54) TOOL BOX WITH A PIVOTABLE PART

(76) Inventor: Chang-Ying Chen, No. 5, Alley 320, Shi Hu Rd., Tali Hsiang, Taichung Hsien (TW)

( * ) Notice: Subject to any disclaimer, the term of this patent is extended or adjusted under 35 U.S.C. 154(b) by 162 days.

(21) Appl. No.: 10/761,299

(22) Filed: Jan. 22, 2004

(65) Prior Publication Data

US 2005/0161356 A1 Jul. 28, 2005

(51) Int. Cl.
*B65D 85/28* (2006.01)

(52) U.S. Cl. ..... 206/379; 206/759; 211/70.6

(58) Field of Classification Search ..... 206/349, 206/372, 373, 376, 377, 379, 759, 763, 765; 211/70.6, 69

See application file for complete search history.

(56) References Cited

U.S. PATENT DOCUMENTS 4,006,821 A * 2/1977 Sautter ..... 206/379
5,813,531 A * 9/1998 Kao ..... 206/373
5,893,457 A * 4/1999 Wei ..... 206/373
6,050,409 A * 4/2000 Delbeck et al. ..... 206/375
6,283,291 B1 * 9/2001 Vasudeva et al. ..... 206/373
6,415,923 B1 * 7/2002 Chen ..... 206/379
6,547,074 B1 * 4/2003 Chen ..... 206/379
6,915,900 B2 * 7/2005 Chen ..... 206/350

* cited by examiner

*Primary Examiner*—Shian T. Luong

(57) ABSTRACT

A tool box includes a base having two first holes in two sides thereof, a pivotable part received in the base and having two arms on two sides thereof and each arm having a second hole, and a cover having two lugs located between the two sides and the two arms. Each first hole has a first notch and each second hole has a second notch defined in an inner periphery thereof. Each lug has a third hole and a protrusion extends from in an inner periphery of each lug. Two shafts extend through the first holes, the third holes and the second holes. Each shaft includes a ridge on an out side thereof and the ridges extend through the first notches and the second notches. The ridges is sized to be engaged with the second notches and can be pushed by the protrusions when the cover is pivoted from a close position to an open position.

4 Claims, 6 Drawing Sheets

TOOL BOX WITH A PIVOTABLE PART

FIELD OF THE INVENTION

The present invention relates to a tool box including a base, a pivotable part for receiving tools therein, and a cover. The pivotable part is pivoted together with the opening of the cover.

BACKGROUND OF THE INVENTION

A conventional tool box generally includes a base and a cover which is pivotably mounted to the base which includes receiving recesses for receiving tools therein. The tools lie on the inside of the base when the cover is opened so that the user has to pick the tools at an angle with his or her fingers. This is not convenient and consumes too much time on picking the tools. Another tool box includes an inner layer for receiving tools and a groove is defined in the inner layer. A drive piece has a protrusion which is slidably engaged with the groove. When the cover is opened, the protrusion moves in the groove and pivots the inner layer at an angle. Nevertheless, the whole weight of the inner layer and the tools are supported on the protrusion which tends to be broken after a period of use. The drive piece, the protrusion and the groove are exposed and do not meet the esthetic purpose.

The present invention intends to provide a tool box that includes two rotatable shafts which are rotated together with the opening of the cover so as to pivot the pivotable part in the tool box.

SUMMARY OF THE INVENTION

The present invention relates to a tool box that includes a base having two first holes in two sides thereof and each first hole has a first notch defined in an inner periphery thereof. A pivotable part has two arms on two sides thereof and each arm has a second hole. Each second hole has a second notch defined in an inner periphery thereof. The pivotable part is received in a space defined in the base and includes recesses for receiving tools. A cover has two lugs and each lug has a third hole. Each third hole has a protrusion extending from in an inner periphery thereof. The two lugs are located between the two arms of the pivotable part and the two sides of the base. The third holes are located in alignment with the first holes and the second hole so that two shafts extend through the first holes, the third holes and the second holes. Each shaft includes a ridge on an out side thereof and the ridges extend through the first notches and the second notches. The ridges is located to be only engaged with the second notches and pushed by the protrusions when the cover is pivoted from a close position to an open position.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
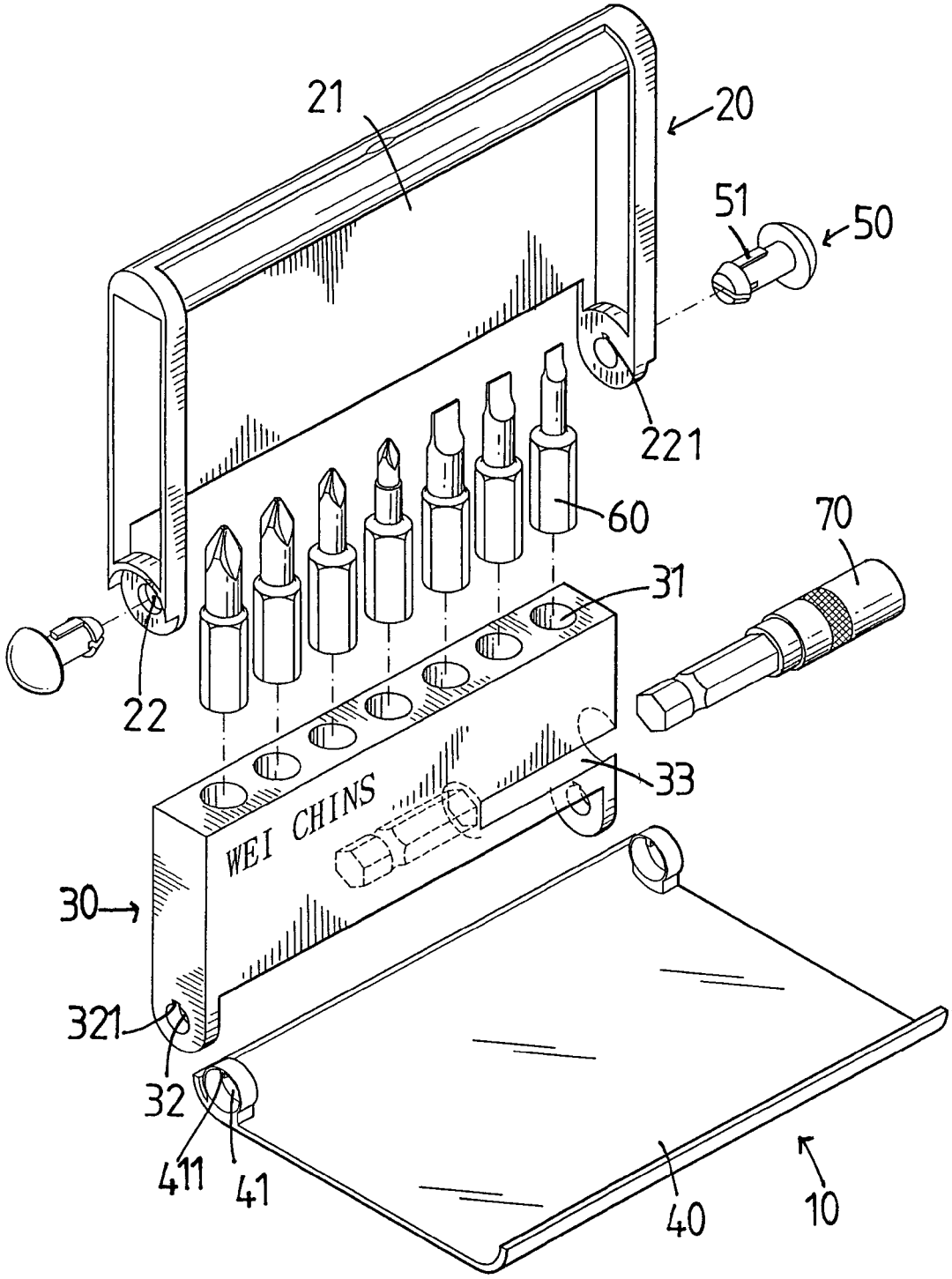
FIG. 1 is an exploded view to show the tool box of the present invention.
Figure 2:
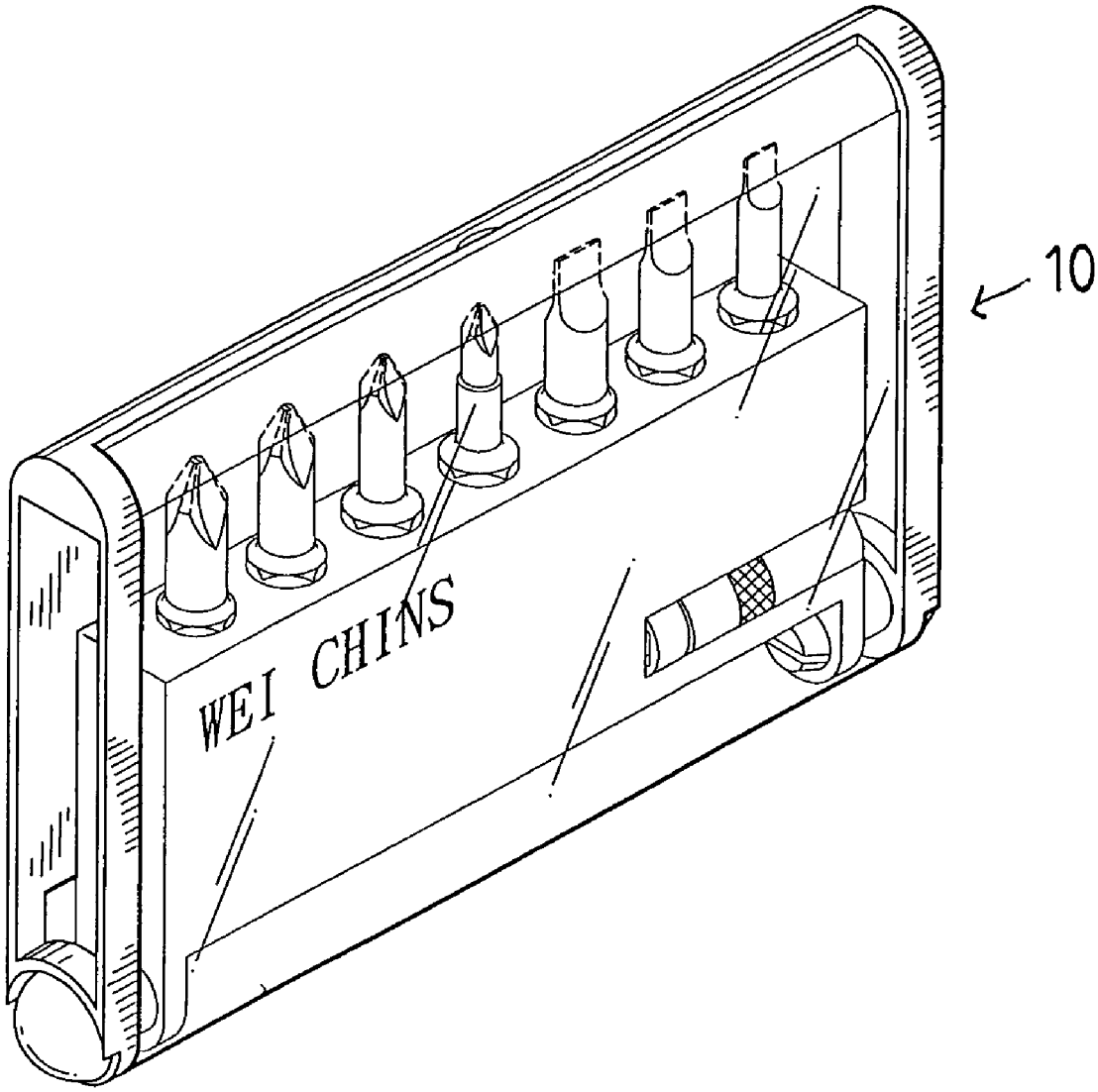
FIG. 2 is a perspective view to show the tool box of the present invention.
Figure 3:
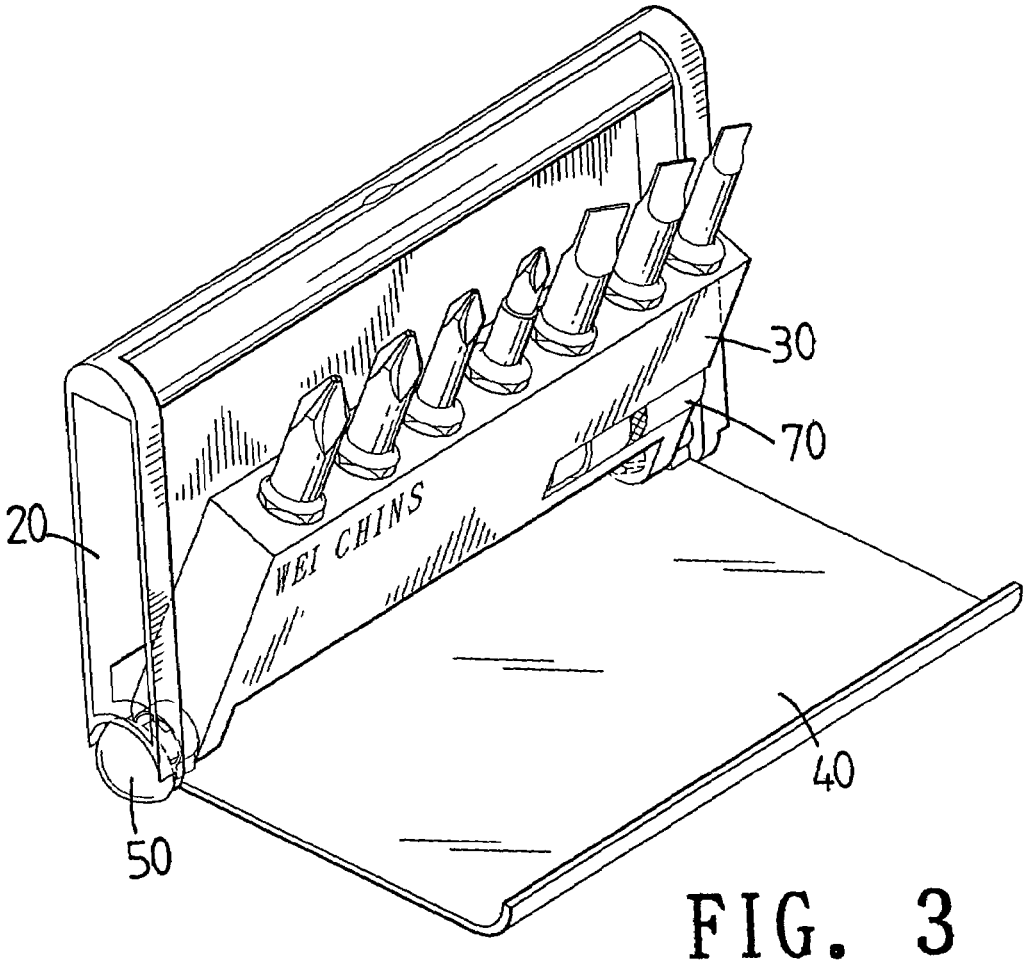
FIG. 3 shows that the pivotable par is pivoted when the cover is opened.
Figure 4:
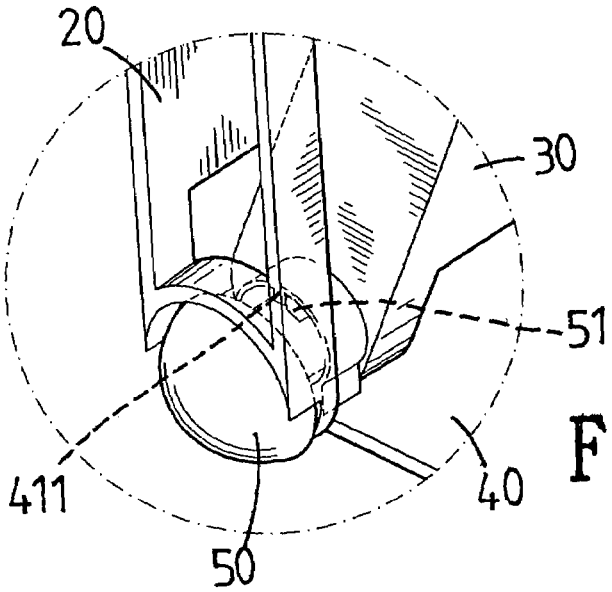
FIG. 4 shows the protrusion of the cover pushes the ridge on the shaft.
Figure 5:
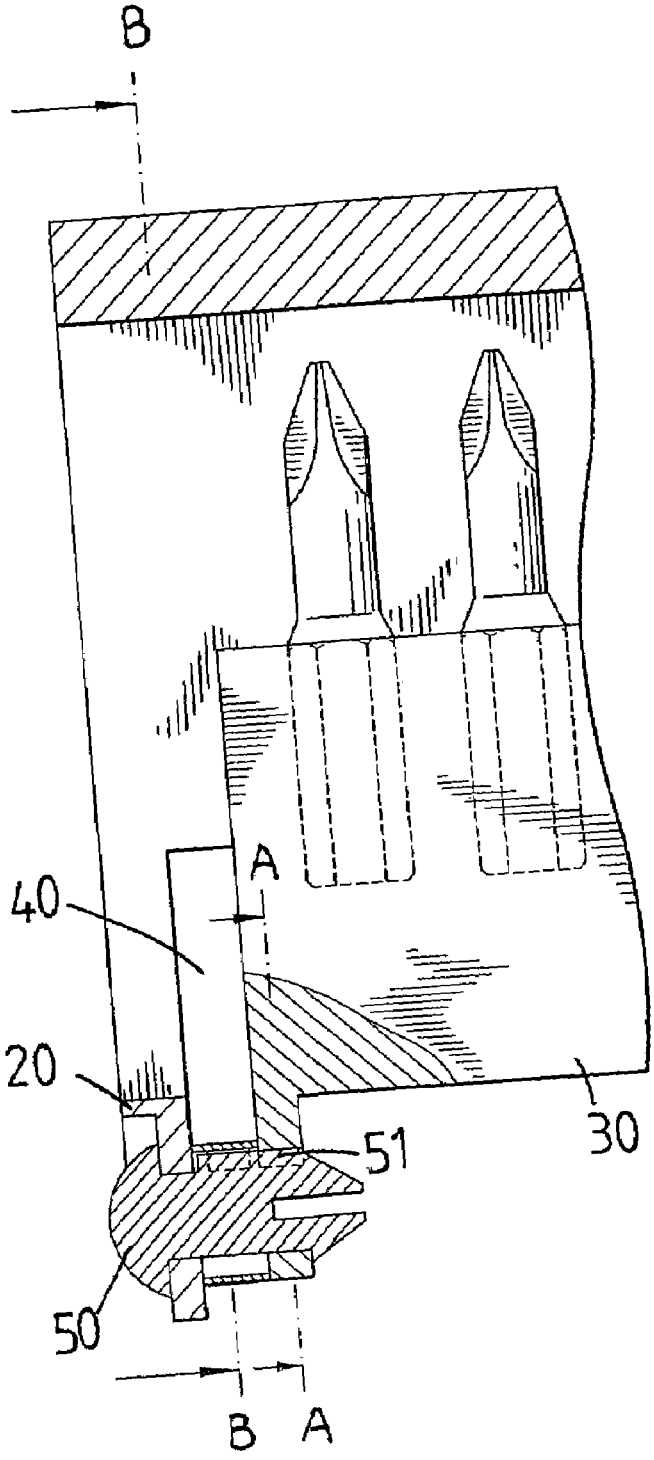
FIG. 5 is a cross sectional view to show the shaft extending through the first hole, the second hole and the third hole.

Referring to FIGS. 1, 2 and 5, the tool box 10 of the present invention comprises a base 20 having two first holes 22 defined in two sides thereof and each first hole 22 has a first notch 221 defined in an inner periphery thereof. A space 21 is defined between the two sides and a front end of the base 20. A pivotable part 30 has two arms on two sides thereof and each arm has a second hole 32. Each second hole 32 has a second notch 321 defined in an inner periphery thereof. A plurality of recesses 31 is defined in a front end thereof so as to receive bits 60 therein. A tubular recess 33 is defined in a side of the pivotable part 30 and a section of the tubular recess 33 opens to a surface of the pivotable part 30. A connection rod 70 can be inserted in the tubular recess 33. The pivotable part 30 is received in the space in the base 20 and the two arms are located between the two sides of the base 20.

A cover 40 has two lugs and each lug has a third hole 41. Each third hole 41 has a protrusion 411 extending from in an inner periphery thereof. The two lugs are located between the two arms of the pivotable part 30 and the two sides of the base 20. The third holes 41 are located in alignment with the first holes 22 and the second hole 32.

Figure 7:
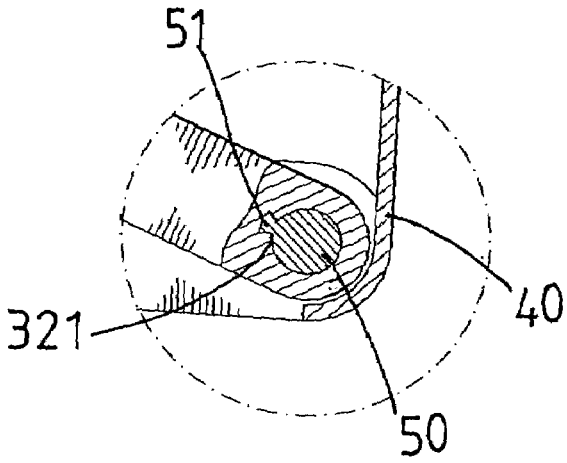
FIG. 7 is a cross sectional view taken from the line B—B in FIG. 5.
Figure 6:
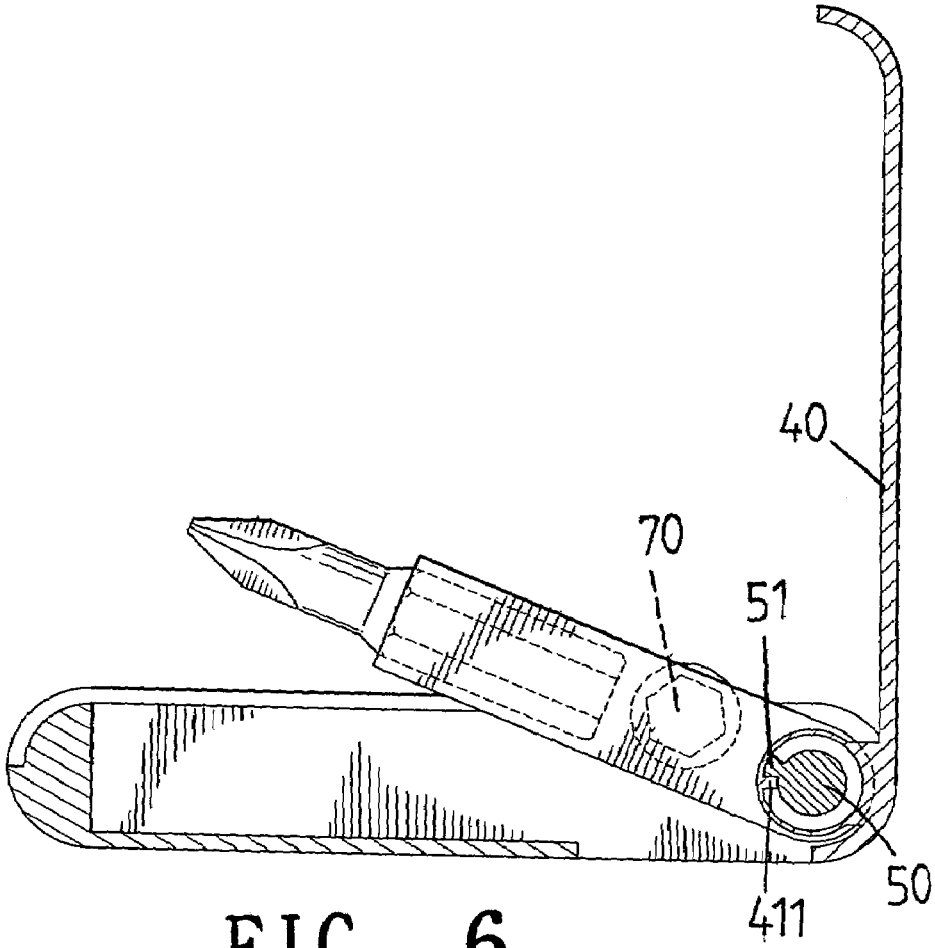
FIG. 6 is a cross sectional view taken from the line A—A in FIG. 5.

Two shafts 50 each have a ridge 51 longitudinally on an out side thereof and each shaft has an enlarged head and an enlarged end opposite to the enlarged head. The ridge 51 of each shaft 50 extends from the enlarged end thereof and the enlarged end is split into two parts by a slit so that the two parts of the enlarged end can be pushed toward each other when the two shafts 50 extend through the first holes 22, the third holes 41 and the second holes 32. The two parts are engaged with the two respective insides of the two arms of the pivotable part 30 after the enlarged ends of the shafts 50 extend beyond the second holes 32. The ridges 51 extend through the first notches 221 and the second notches 321. The ridges 51 are sized to be only engaged with the second notches 321 as shown in FIG. 7.

Figure 9:
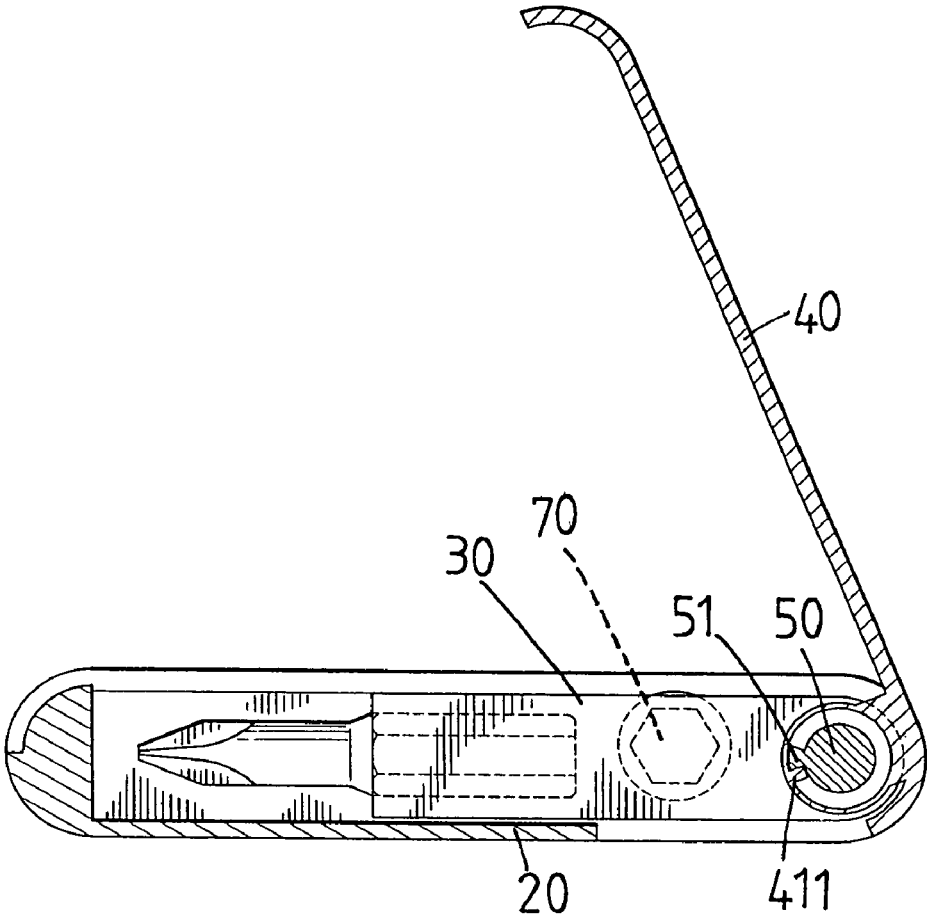
FIG. 9 shows the position of the protrusion when the cover is in open position.
Figure 8:
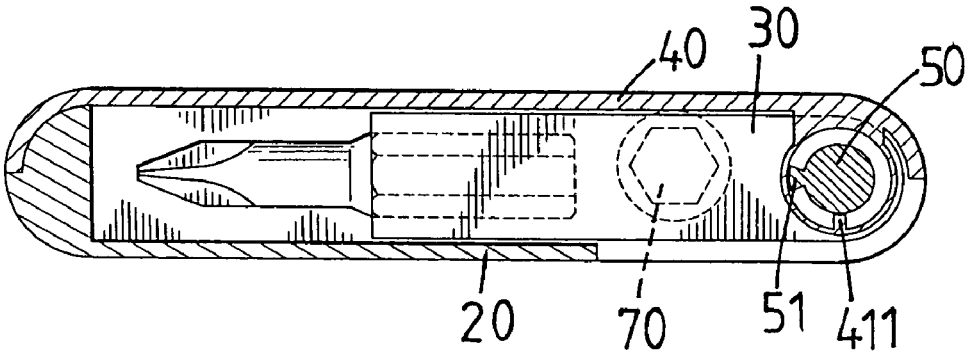
FIG. 8 shows the position of the protrusion when the cover is in close position.

Further referring to FIG. 8, when the cover 40 is in close position, the pivotable part 30 lies on an inside of the space of the base 20 and the protrusions 411 are located at an angular distance from the ridges 51 on the shafts 50. Referring to FIGS. 3, 4, 6 and 9, when the cover 40 is pivoted from the close position to the open position, the protrusions 411 are moved and contacts the ridges 51 at an angle as shown in FIG. 9. When the cover 40 is kept on pivoting, the ridges 51 are pushed by the protrusions 411 and the pivotable part 30 is then pivoted upward.

While we have shown and described the embodiment in accordance with the present invention, it should be clear to those skilled in the art that further embodiments may be made without departing from the scope of the present invention.

What is claimed is:

1. A tool box comprising:

a base having two first holes defined in two sides thereof and each first hole having a first notch defined in an inner periphery thereof;

a pivotable part having two arms on two sides thereof and each arm having a second hole, each second hole having a second notch defined in an inner periphery thereof, a plurality of recesses defined therein, the pivotable part received in a space defined in the base and the two arms located between the two sides of the base;

a cover having two lugs and each lug having a third hole, each third hole having a protrusion extending from in an inner periphery thereof, the two lugs being located between the two arms of the pivotable part and the two sides of the base, the third holes being located in alignment with the first holes and the second holes, and two shafts each having a ridge longitudinally on an out side thereof, the two shafts extending through the first holes, the third holes and the second holes, the ridges extending through the first notches and the second notches, the ridges being sized to be engaged with the second notches and being pushed by the protrusions when the cover is pivoted from a close position to an open position.

2. The tool box as claimed in claim 1, wherein the two shafts each have an enlarged end which is split into two parts by a slit, the two parts engaged with the two respective insides of the two arms of the pivotable part.

3. The tool box as claimed in claim 2, wherein the ridge of each shaft extends from the enlarged end.

4. The tool box as claimed in claim 1, wherein a tubular recess is defined in a side of the pivotable part and a section of the tubular recess opens to a surface of the pivotable part.

* * * * *